US007609136B2

(12) United States Patent
Wang et al.

(10) Patent No.: US 7,609,136 B2
(45) Date of Patent: Oct. 27, 2009

(54) MEMS MICROSWITCH HAVING A CONDUCTIVE MECHANICAL STOP

(75) Inventors: Xuefeng Wang, Schenectady, NY (US); Kanakasabapathi Subramanian, Clifton Park, NY (US); Christopher Fred Keimel, Schenectady, NY (US); Marco Francesco Aimi, Niskayuna, NY (US); Kuna Venkat Satya Rama Kishore, Bangalore (IN); Glenn Scott Claydon, Wynantskill, NY (US); Oliver Charles Boomhower, Waterford, NY (US); Parag Thakre, Bangalore (IN)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/961,767

(22) Filed: Dec. 20, 2007

(65) Prior Publication Data

US 2009/0159410 A1 Jun. 25, 2009

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 6,307,169 | B1 * | 10/2001 | Sun et al. | 200/181 |
| 6,384,353 | B1 * | 5/2002 | Huang et al. | 200/181 |
| 6,608,268 | B1 * | 8/2003 | Goldsmith | 200/181 |
| 6,646,215 | B1 * | 11/2003 | Nelson | 200/181 |
| 6,657,525 | B1 * | 12/2003 | Dickens et al. | 335/78 |
| 6,657,832 | B2 * | 12/2003 | Williams et al. | 200/181 |
| 6,967,548 | B2 * | 11/2005 | Ma et al. | 333/262 |
| 6,998,946 | B2 * | 2/2006 | Feng et al. | 335/78 |
| 7,212,091 | B2 * | 5/2007 | Andricacos et al. | 335/78 |
| 7,283,024 | B2 * | 10/2007 | Bar et al. | 200/181 |
| 7,385,744 | B2 * | 6/2008 | Kogut et al. | 359/198 |
| 2003/0116417 | A1 * | 6/2003 | DeReus | 200/181 |
| 2005/0184836 | A1 | 8/2005 | Chou | |

OTHER PUBLICATIONS

European Search Report dated Apr. 28, 2009.

* cited by examiner

*Primary Examiner*—Lincoln Donovan
*Assistant Examiner*—Bernard Rojas
(74) *Attorney, Agent, or Firm*—Richard Emery

(57) ABSTRACT

A MEMS switch includes a substrate, a movable actuator coupled to the substrate, a substrate contact, a substrate electrode, and a conductive stopper electrically coupled to the movable actuator and structured to prevent the movable actuator from contacting the substrate electrode while allowing the movable actuator to make contact with the substrate contact.

25 Claims, 4 Drawing Sheets

MEMS MICROSWITCH HAVING A CONDUCTIVE MECHANICAL STOP

BACKGROUND

Embodiments of the invention relate generally to a microelectromechanical system (MEMS) switch having a conductive mechanical stop.

Microelectromechanical systems (MEMS) are electromechanical devices that generally range in size from a micrometer to a millimeter in a miniature sealed package. A MEMS device in the form of a microswitch has a movable actuator, also referred to as a beam, that is moved toward a stationary electrical contact by the influence of a gate or substrate electrode positioned on a substrate below or otherwise near the movable actuator. The movable actuator may be a flexible beam that bends under applied forces such as electrostatic attraction, magnetic attraction and repulsion, or thermally induced differential expansion, that closes a gap between a free end of the beam and the stationary contact.

FIG. 1 illustrates a cross-sectional representation of a MEMS switch in an open or non-conducting state according to the prior art. The MEMS switch 10 includes a substrate 12, an insulating layer 14 disposed over the substrate 12 and a movable actuator 23 mechanically coupled or anchored to a source electrode 18 as shown. The movable actuator 23 includes a movable contact 17, which upon deflection of the movable actuator 23 makes contact with a substrate contact 15 disposed on but electrically isolated from the substrate 12. The substrate electrode 16 is positioned below the movable actuator 23 such that when an actuation voltage is applied to the substrate electrode 16, the movable actuator 23 deflects such that contact is made between the movable and stationary (e.g., substrate) contacts to allow current to flow. In order to keep the conductive movable actuator 23 from contacting the substrate electrode 16 and electrically shorting the switch when in such a conducting state, a dielectric layer 20 is typically coated over the substrate electrode 16 as illustrated in FIG. 2. This dielectric layer is often disposed over the substrate electrode 16 but it may instead be coated on the underside of the movable actuator 23.

However, such a dielectric insulation layer can trap charge over time and negatively affect the operation of the actuator such as causing it to malfunction (e.g., cause stiction of the electrode), change the actuation and stand-off voltages, change the response time of the switch, shorten its operating lifetime, and so forth. This can be especially problematic in power conduction applications where inadvertent actuation can cause undesirable conduction modes and/or switch damage.

BRIEF DESCRIPTION

In one embodiment, a MEMS switch includes a substrate, a movable actuator coupled to the substrate, a substrate contact, a substrate electrode; and a conductive stopper electrically coupled to the movable actuator and structured to prevent the movable actuator from contacting the substrate electrode while allowing the movable actuator to make contact with the substrate contact.

In another embodiment, a MEMS switch includes a substrate, a movable actuator coupled to the substrate, a substrate contact, a substrate electrode, and a conductive stopper located on the substrate and electrically coupled to the movable actuator such that the conductive stopper and the movable actuator maintain the same electrical potential.

In a further embodiment, a MEMS switch includes a substrate, a movable actuator coupled to the substrate and comprising a conductive stopper, a substrate contact, a substrate electrode, and a conductive trace electrically coupled to the movable actuator and located on the substrate at least partially below the movable actuator such that the conductive stopper makes electrical contact with the conductive trace and the movable actuator makes electrical contact with the substrate contact when the switch is actuated.

In yet a further embodiment, a MEMS switch array formed on a shared substrate is provided. The switch array includes a first movable actuator coupled to the substrate, a second movable actuator coupled to the substrate, a substrate electrode located on the substrate at least partially below the first and second movable actuators, and a substrate contact located on the substrate at least partially below the first and second movable actuators such that the first and second movable actuators make electrical contact with the substrate contact based upon a state of the substrate electrode. The switch array further includes at least one conductive stopper electrically coupled to the movable actuators and structured to prevent the movable actuators from contacting the substrate electrode while allowing the movable actuators to make contact with the substrate contact.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
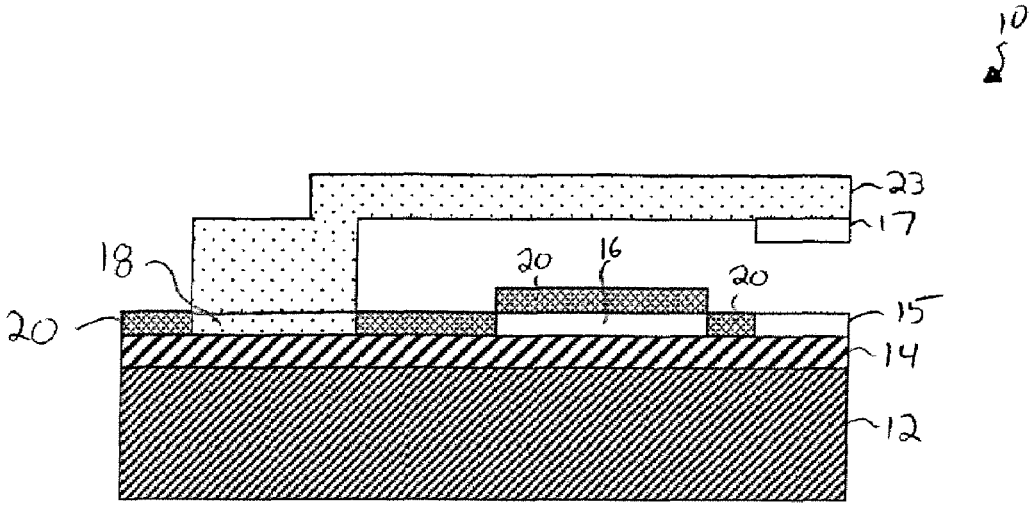
FIG. 1 (PRIOR ART)
FIG. 1 illustrates a cross-sectional representation of a MEMS switch in an open or non-conducting state according to the prior art.
Figure 2:
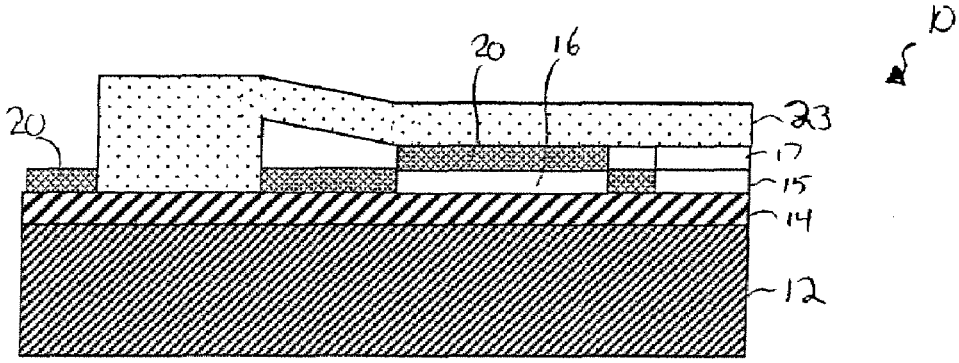
FIG. 2 (PRIOR ART)
FIG. 2 illustrates a cross-sectional representation of a MEMS switch 10 in an actuated state according to the prior art.

In accordance with embodiments of the invention, a MEMS switch and switch array are described wherein the conventional dielectric insulator that traditionally separates the substrate electrode from the movable actuator is removed. In accordance with various embodiments of the invention, a conductive stopper is provided that is electrically coupled to the movable actuator and structured to prevent the movable actuator from contacting the substrate electrode while allowing the movable actuator to make contact with the substrate contact. Since the conductive stopper prevents the movable actuator from making contact with the substrate electrode, the dielectric insulator used in conventional MEMS switches can be removed thereby eliminating a source of undesirable charge accumulation and increasing the standoff voltage of the MEMS switch described herein. Furthermore, by electrically coupling the movable actuator and the conductive stopper, they can be maintained at the same electrical potential thereby minimizing chances of arcing between the movable actuator and the conductive stopper to which convention MEMS switches are susceptible.

In the following detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. In other instances, well known methods, procedures, and components have not been described in detail.

Furthermore, various operations may be described as multiple discrete steps performed in a manner that is helpful for understanding embodiments of the present invention. However, the order of description should not be construed as to imply that these operations need be performed in the order they are presented, nor that they are even order dependent. Moreover, repeated usage of the phrase "in one embodiment" does not necessarily refer to the same embodiment, although it may. Lastly, the terms "comprising", "including", "having", and the like, as well as their inflected forms as used in the present application, are intended to be synonymous unless otherwise indicated.

MEMS generally refer to micron-scale structures that can integrate a multiplicity of functionally distinct elements such as mechanical elements, electromechanical elements, sensors, actuators, and electronics, on a common substrate through micro-fabrication technology. It is contemplated, however, that many techniques and structures presently available in MEMS devices will in just a few years be available via nanotechnology-based devices, for example, structures that may be smaller than 100 nanometers in size. Accordingly, even though example embodiments described throughout this document may refer to MEMS-based switching devices, it is submitted that the embodiments should be broadly construed and should not be limited to only micron-sized devices unless otherwise limited to such.

Figure 3:
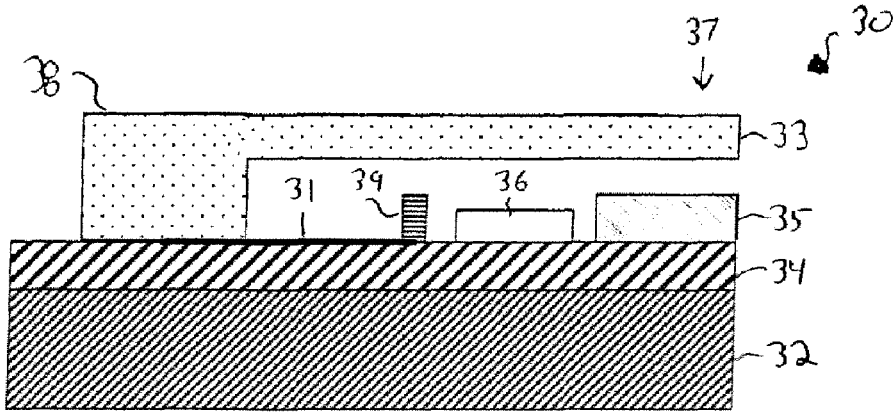
FIG. 3 illustrates a cross-sectional representation of a MEMS switch 30 including a conductive mechanical stop in an open state, in accordance with one embodiment of the invention.

FIG. 3 illustrates a cross-sectional representation of a MEMS switch 30 including a conductive mechanical stop in accordance with one embodiment of the invention. In the illustrated embodiment, MEMS switch 30 includes a substrate 32 which may be conductive, semi-conductive or insulating. In an embodiment where the substrate 32 is conductive, the substrate may be coated with an insulating or electrical isolation layer 34 to prevent undesirable shorting between and amongst substrate electrodes and substrate contacts (to be described further below). Non-limiting examples of conducting substrates include those formed from silicon and germanium, whereas non-limiting examples of an electrical isolation layer include silicon nitride, silicon oxide, and aluminum oxide.

The MEMS switch 30 further includes a movable actuator 33 (often referred to as a beam) that is mechanically coupled or anchored to the substrate 32 by an anchor 38. In one embodiment, the movable actuator 33 is conductive such that current can flow from a "source" contact (not illustrated) at the base of the anchor 38, through the movable actuator 33, and through to a substrate contact 35 (sometimes referred to as a drain contact). In one embodiment, the movable actuator 33 is formed from gold or a gold alloy, however, the movable actuator 33 may further include resistive or non-conducting materials and one or more stress compensation layers depending upon the design of the MEMS switch. Similarly, the substrate contact 35 may be formed from a variety of conductive materials or compositions or alloys thereof. In one embodiment, the substrate contact 35 may be made from gold or a gold alloy for example. The substrate 32 may be biased at any desired electrical potential. In one embodiment, to reduce any attraction force (e.g., such as but not limited to electrostatic and magnetic attraction forces) between the substrate and the movable actuator 33, the substrate may be biased at the same electrical potential as the movable actuator 33. This can be achieved through a substrate contact electrode or by electrically connecting the anchor 38 to the substrate 32.

In the illustrated embodiment, the MEMS switch 30 further includes a substrate electrode 36. The substrate electrode 36 may also comprise one or more conductive materials, compositions or alloys thereof. As with the substrate contact 35, the substrate electrode 36 may similarly be made from gold or a gold alloy. Moreover, the substrate electrode 36 and the substrate contact 35 may be formed from the same photolithographic process mask. In one embodiment, the conductive material of the substrate electrode 36 is left exposed without the addition of a dielectric layer traditionally used to prevent direct contact between movable actuators and substrate electrodes. Moreover, in accordance with one embodiment, the bottom surface of the movable actuator 33 may further include an exposed conductive surface opposite the exposed conductive surface of the substrate electrode 36.

In the illustrated embodiment, movable actuator 33 represents a cantilever beam having a stationary end (e.g., anchor 38) and a movable end 37, which deflects toward substrate 32 upon application of a voltage differential between the substrate electrode 36 and the movable actuator 33. However, the teachings herein may similarly apply to other forms of MEMS switches beyond those depicted in the Figures. For example, the movable actuator 33 could be anchored at two or more ends or sides resembling a bridge or diaphragm type switch. Similarly, the actuation of the movable actuator 33 may be substantially out of plane (e.g., perpendicular to the substrate) as shown in the Figures, or substantially in-plane (e.g., parallel to the substrate).

Figure 4:
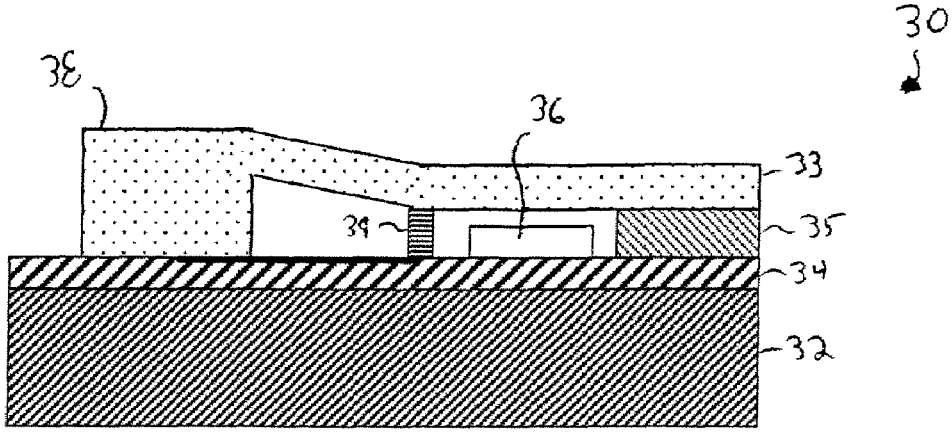
FIG. 4 illustrates a cross-sectional representation of the MEMS switch 30 including a conductive mechanical stop in an actuated state, in accordance with one embodiment of the invention.

In accordance with one embodiment of the invention, one or more conductive stoppers are provided to prevent the movable actuator from contacting one or more substrate electrodes while allowing the movable actuator to make contact with the substrate contact upon actuation. As illustrated in FIG. 3 and FIG. 4, a conductive stopper 39 may be provided on the substrate 32 so as to prevent the movable actuator 33 from contacting the substrate electrode 36 while allowing the movable actuator 33 to deflect at the movable end 37 to make contact with the substrate contact 35 upon actuation of the switch. The conductive stopper 39 may include one or more conductive materials or compositions or alloys thereof. Further, the conductive stopper 39 may be formed from the same material as the movable actuator 33 or from a different material. In an embodiment where the conductive stopper 39 and the movable actuator 33 are fabricated from different materials, the conductive stopper 39 may be designed to have a higher resistivity than the movable actuator 33 so as to decrease the chance of arcing between the conductive stopper 39 and the movable actuator 33.

Figure 5:
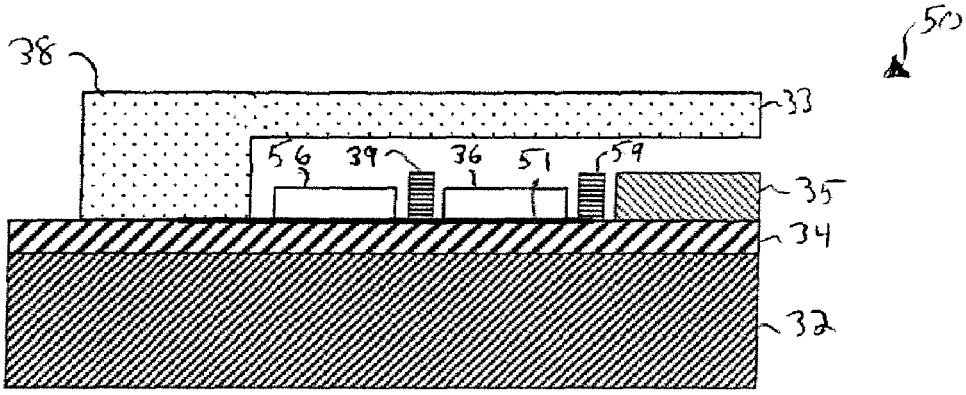
FIG. 5 illustrates a cross-sectional representation of a MEMS switch including more than one conductive mechanical stop, in accordance with one embodiment of the invention.
Figure 6:
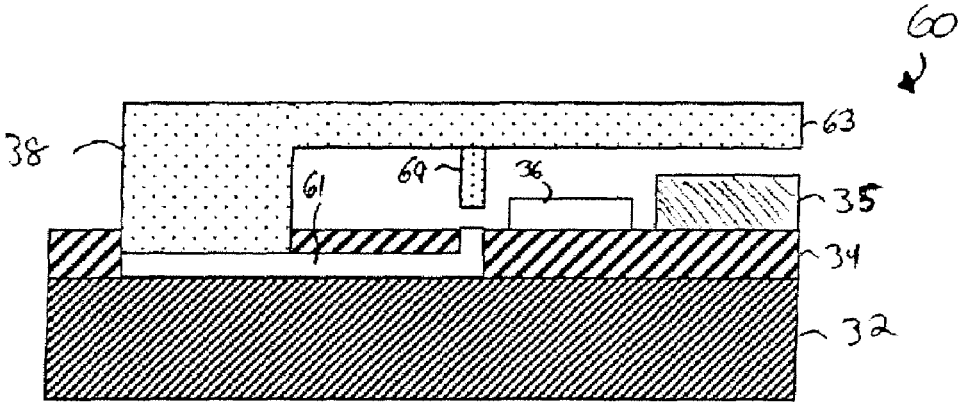
FIG. 6 illustrates a cross-sectional representation of a MEMS switch including a movable actuator having a conductive stopper, in accordance with one embodiment of the invention.
Figure 7:
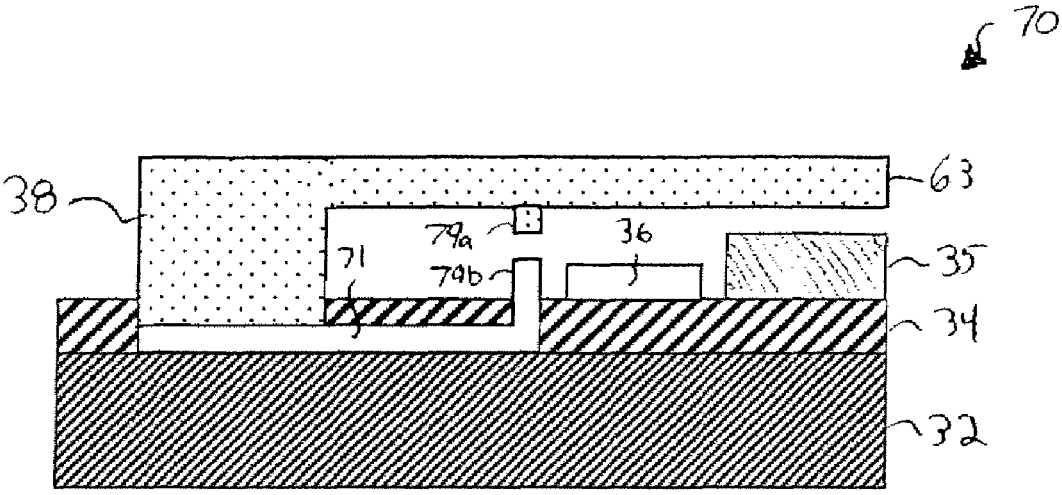
FIG. 7 illustrates a cross-sectional representation of a MEMS switch having a split conductive stopper, in accordance with one embodiment of the invention.
Figure 8:
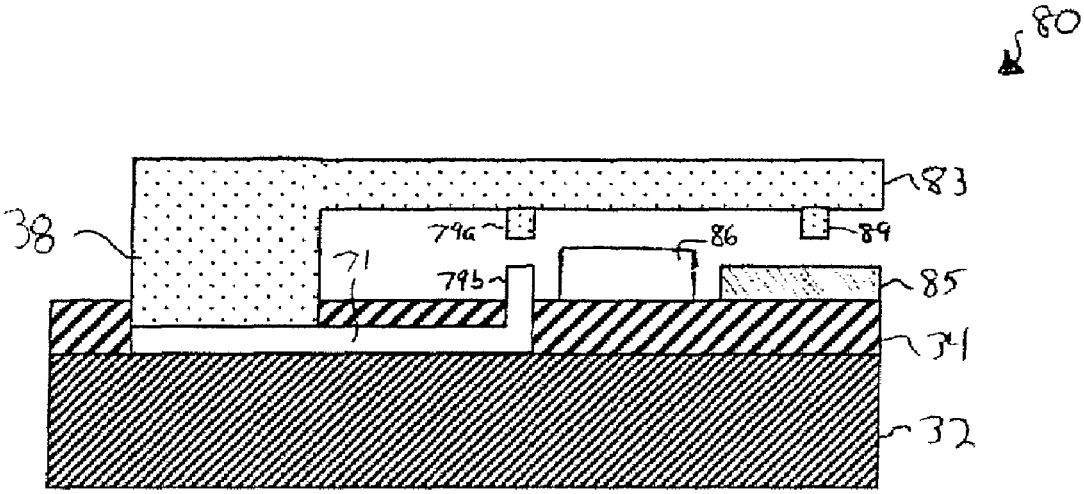
FIG. 8 illustrates a cross-sectional representation of a MEMS switch having a split conductive stopper and a conductive contact bump, in accordance with one embodiment of the invention.

Each conductive stopper 39 can be fabricated on the substrate (e.g., as shown in FIGS. 3, 4 and 5), or as part of the movable actuator (e.g., as shown in FIG. 6), or may be divided into two parts (e.g., as shown in FIGS. 7 and 8) with a first portion formed on the substrate and at least one other portion formed as part of the movable actuator 33. In an embodiment where the conductive stopper 39 is formed on the substrate, the conductive stopper can be formed using the same photolithographic process mask as may be used for forming the substrate contact 35 or the substrate electrode 36.

In one embodiment, the conductive stop 39 may be positioned such that the substrate electrode 36 is located between the substrate contact 35 and the conductive stopper 39. The closer the substrate electrode is to the substrate contact the more force that is available to pull the movable actuator towards the substrate contact. By positioning the conductive stop 39 such that one or more substrate electrodes 36 are located between the substrate contact 35 and the conductive stop 39, it is possible to increase the actuation force at the movable end 37 to provide better contact between the movable actuator 33 and the substrate contact 35. Optionally, in any of the embodiments described herein, an additional conductive contact may be provided on the movable end 37 of the movable actuator 33.

In accordance with one embodiment, the form factor of the conductive stopper 39 may be varied depending upon a variety of factors. For example, a conductive stopper for a single MEMS switch may resemble a pillar or post, whereas a conductive stopper for a switch array may resemble a beam. In one embodiment, the conductive stopper may have a height (e.g., the dimension extending toward the movable actuator 33) that is greater than its length or width. In one embodiment, the conductive stopper 39 may be structured such that the moveable electrode 33 contacts the substrate contact 35 before it contacts the conductive stopper. In an alternative embodiment, the conductive stopper 39 may be structured such that the moveable electrode 33 contacts the substrate contact 35 at substantially the same time as it contacts the conductive stopper. In yet another alternative embodiment, the conductive stopper 39 may be structured such that the moveable electrode 33 first contacts the conductive stopper 39 before contacting the substrate contact 35. In such an embodiment, the conductive stopper 39 may have a height that is greater than that of the substrate contact 35. By fabricating the conductive stopper 39 to be taller (e.g., closer to the movable actuator) than the substrate contact 35, it is possible to increase the effective resonant frequency of the movable contact 33 resulting in faster parting between the substrate contact 35 and the movable actuator 33. Furthermore, by making the conductive stopper 39 taller than the substrate contact 35, the movable actuator 33 will contact the conductive stopper 39 first requiring an increased pull-in voltage to actuate the beam.

In one embodiment, the conductive stopper 39 is electrically coupled to the movable actuator 33 to maintain the same electrical potential between the conductive stopper 39 and the movable actuator 33. In power conduction applications for example, this can be a desirable feature as the movable actuator 33 and the mechanical stop 39 can otherwise be at different electrical potentials. The resulting potential difference could in turn generate an attraction force between the mechanical stop 39 and the movable actuator 33. This may cause the movable actuator 33 to actuate or deflect at undesirable times, in turn reducing the standoff voltage of the switch. In one embodiment, one or more mechanical stops, such as mechanical stop 39, may be electrically coupled to the movable contact 33 by conductive trace 31. In one embodiment, the conductive trace 31 may be routed on the surface of or otherwise above the electrical isolation layer 34 at least partially below the movable actuator 33. In another embodiment, the conductive trace 31 may be routed between the electrical isolation layer 34 and the substrate 32. The conductive trace 34 may be formed from one or more conductive material such as copper gold, aluminum, platinum, or metal alloys.

FIG. 5 illustrates a cross-sectional representation of a MEMS switch including more than one conductive mechanical stop, in accordance with one embodiment of the invention. As illustrated, MEMS switch 50 includes at least one additional conductive stopper 59. Conductive stopper 59 may be substantially similar in materials and design as conductive stopper 39. Alternatively, the conductive stopper 59 and the conductive stopper 39 may have different form factors (including heights) depending upon the desired application. In one embodiment, the conductive stopper 59 and the conductive stopper 39 may be electrically coupled to the movable actuator 33 by a conductive trace 51 which may be substantially similar in design to the previously described conductive trace 31. Additionally, MEMS switch 50 may further include one or more additional substrate electrodes such as the substrate electrode 56 depicted in FIG. 5. Each such additional substrate electrode may be substantially similar in form and function as the previously described substrate electrode 36.

FIG. 6 illustrates a cross-sectional representation of a MEMS switch including a movable actuator having a conductive stopper, in accordance with one embodiment of the invention. As with the previously described MEMS switch embodiments, MEMS switch 60 includes a substrate 32, an electrical isolation layer 34, a substrate contact 35 and a substrate electrode 36. However, rather than including a conductive stopper that is formed as part of the substrate portion, MEMS switch 60 includes a movable conductive stopper 69 that is coupled to or otherwise integrated with the movable actuator 63. Additionally, a conductive trace 61 is provided that is routed from a location approximately below the conductive stopper 69 to the movable actuator 63 (e.g., by way of anchor 38) such that the conductive stopper 69 contacts the conductive trace 61 upon actuation of the switch. In one embodiment, the distance separating the conductive stopper 69 from the conductive trace 61 is the same as the distance separating the movable actuator 63 from the substrate contact 35.

FIG. 7 illustrates a cross-sectional representation of a MEMS switch having a split conductive stopper, in accordance with one embodiment of the invention. In the illustrated embodiment, a MEMS switch 70 is shown having a split or divided conductive stopper including a first movable portion 79*a* coupled to or integrated with the movable contact 63, and a stationary second portion 79*b* coupled to the substrate and positioned to make contact with the first movable portion 79*a* upon actuation of the switch 70. In one embodiment, the stationary second portion 79*b* may further be electrically coupled to the movable actuator by a conductive trace 71. As with the previously described conductive traces (31, 51, 61), conductive trace 71 may be routed on top of or below electrical isolation layer 34.

FIG. 8 illustrates a cross-sectional representation of a MEMS switch having a split conductive stopper and a conductive contact bump, in accordance with one embodiment of the invention. As with the MEMS switch 70, the MEMS switch 80 may further include a split conductive stopper having a first movable portion 79*a* on the movable actuator 83 and a second stationary portion 79*b* positioned below the movable portion. In addition, the MEMS switch 80 may further include a protrusion such as a conductive contact bump 89 on the movable actuator 83, which upon actuation of the movable actuator 83 makes contact with the substrate contact 85. With the addition of conductive contact bump 89, it is possible to have a substrate electrode (such as substrate electrode 86) with a height that is greater than the height of the substrate contact as illustrated.

Figure 9:
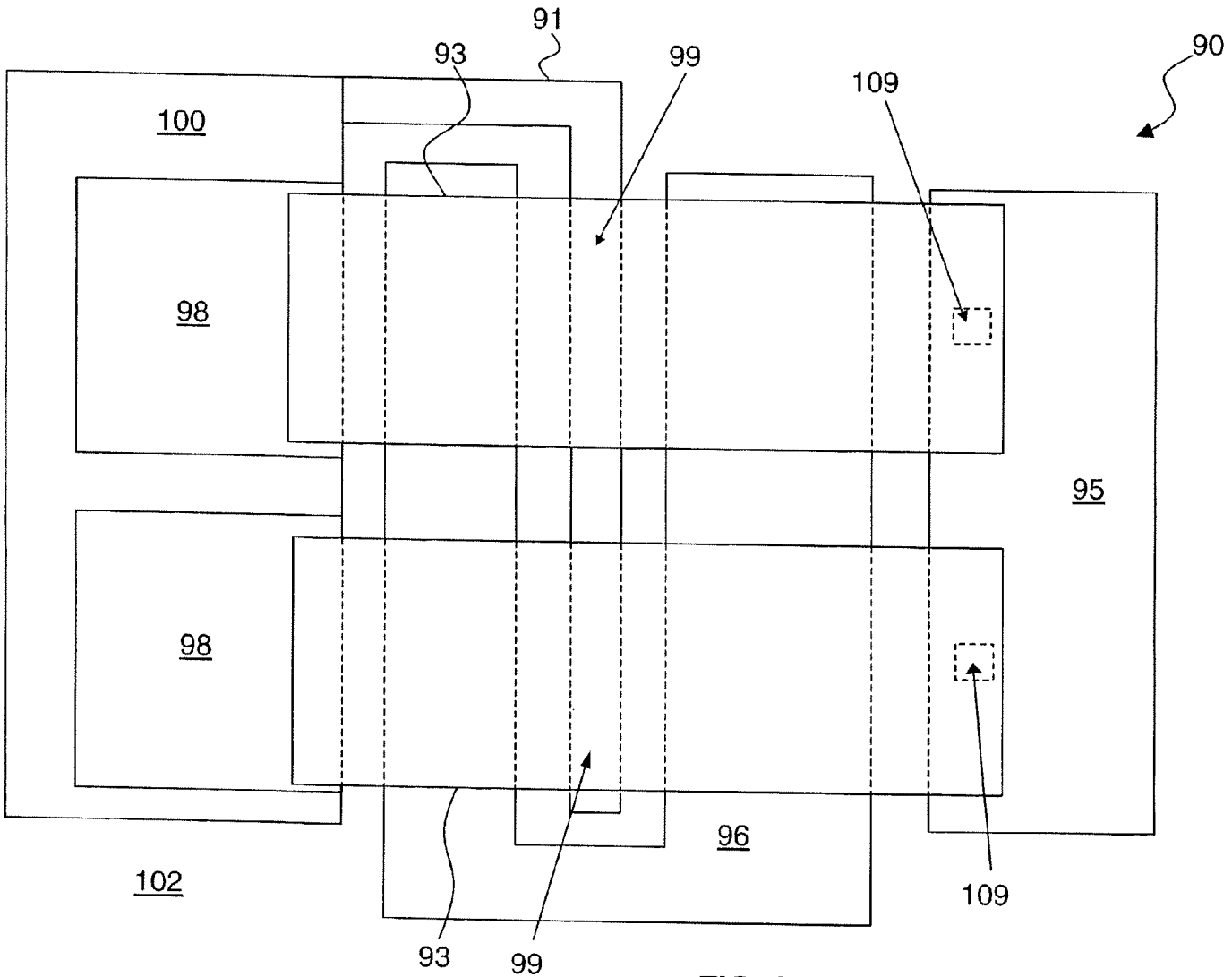
FIG. 9 illustrates one embodiment of a MEMS switch array including at least two MEMS switches with at least one conductive stopper.

FIG. 9 illustrates one embodiment of a MEMS switch array 90 including two MEMS switches 98 each having with at least one conductive stopper 99. For the purposes of explanation, only two MEMS switches are illustrated in the MEMS switch array 90. However, although not illustrated, MEMS switch array 90 may include a large number of MEMS switches coupled in series, parallel, or series-parallel arrangements. Each MEMS switch in MEMS switch array 90 includes two movable actuators 93 anchored to a "source" contact 100 disposed on a substrate 102. The movable actuators 93 extend or are cantilevered over substrate electrode 96 and substrate contact 95 also located on the substrate 102. As previously described, the substrate 102 may further include an electrical isolation layer (not shown) disposed between the substrate 102 and one or more of the substrate electrode 96, the substrate contact 95 and the source electrode 100 or anchor 98.

In accordance with one embodiment, each MEMS switch further includes a conductive stopper 99. As previously described, the conductive stoppers 99 may be fabricated on the substrate 102, on the movable actuator 93 or partly on the substrate 102 and partly on the movable actuator 93. In an embodiment where the conductive stopper 99 is fabricated at least partly on the substrate 102, the conductive stopper 99 may be electrically coupled to the movable actuator 93 by way of the conductive trace 91 and the source contact 100 and/or the anchor 98. In an embodiment where the conductive stopper 99 is fabricated at least partly on the movable actuator, the conductive stopper 99 may be electrically conducted to the conductive trace 91 only upon actuation of the switch. Additionally, each MEMS switch may further include one or more conductive contact bumps 109 included on the underside of movable actuator 93.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A MEMS switch comprising:

a substrate;

a movable actuator coupled to the substrate;

a substrate contact;

a substrate electrode; and a conductive stopper electrically coupled to the movable actuator via a conductive trace and structured to prevent the movable actuator from contacting the substrate electrode while allowing the movable actuator to make contact with the substrate contact.

2. The MEMS switch of claim 1, wherein the movable actuator and the substrate electrode are electrically isolated from the substrate.

3. The MEMS switch of claim 1, wherein the movable actuator comprises a conductive beam.

4. The MEMS switch of claim 3, wherein the movable actuator comprises a conductive cantilever beam.

5. The MEMS switch of claim 3, wherein the conductive stopper has a higher resistivity than the conductive beam.

6. The MEMS switch of claim 1, wherein the substrate electrode consists of a conductor.

7. The MEMS switch of claim 1, wherein the conductive stopper is located on the substrate and the substrate electrode is located between the conductive stopper and the substrate contact.

8. The MEMS switch of claim 7, wherein conductive stopper is structured such that the movable actuator makes contact with the conductive stopper before it makes contact with the substrate contact.

9. The MEMS switch of claim 1, further comprising the conductive trace electrically coupled to the movable actuator and located on the substrate at least partially under the movable actuator.

10. The MEMS switch of claim 9, further comprising an isolation layer between the substrate and the substrate electrode, wherein the conductive trace is located between the substrate and the isolation layer.

11. The MEMS switch of claim 9, wherein the conductive stopper is integrated with the movable actuator such that when the movable actuator is actuated, the conductive stopper contacts the conductive trace.

12. A MEMS switch comprising:

a substrate;

a movable actuator coupled to the substrate;

a substrate contact;

a substrate electrode; and a conductive stopper located on the substrate and electrically coupled to the movable actuator such that the conductive stopper and the movable actuator maintain the same electrical potential.

13. The MEMS switch of claim 12, wherein the substrate electrode is located between the conductive stopper and the substrate contact.

14. The MEMS switch of claim 12, wherein the movable actuator and the substrate electrode are electrically isolated from the substrate.

15. The MEMS switch of claim 12, wherein the movable actuator comprises a conductive beam.

16. The MEMS switch of claim 15, wherein the movable actuator comprises a conductive cantilever beam.

17. The MEMS switch of claim 15, wherein the conductive stopper has a higher resistivity than the conductive beam.

18. A MEMS switch comprising:

a substrate;

a movable actuator coupled to the substrate and comprising a conductive stopper;

a substrate contact;

a substrate electrode; and a conductive trace electrically coupled to the movable actuator and located on the substrate at least partially below the movable actuator such that the conductive stopper makes electrical contact with the conductive trace and the movable actuator makes electrical contact with the substrate contact when the switch is actuated.

19. A MEMS switch array formed on a shared substrate comprising:

a first movable actuator coupled to the substrate;

a second movable actuator coupled to the substrate;

a substrate electrode located on the substrate at least partially below the first and second movable actuators;

a substrate contact located on the substrate at least partially below the first and second movable actuators such that the first and second movable actuators make electrical contact with the substrate contact based upon a state of the substrate electrode; and at least one conductive stopper electrically coupled to the movable actuators via a conductive trace and structured to prevent the movable actuators from contacting the substrate electrode while allowing the movable actuators to make contact with the substrate contact.

20. The MEMS switch array of claim 19, wherein the movable actuators comprise conductive cantilever beams.

21. The MEMS switch array of claim 20, wherein the at least one conductive stopper has a higher resistivity than the conductive beams.

22. The MEMS switch array of claim 19, the substrate electrode consists essentially of a conductor.

23. The MEMS switch array of claim 19, wherein the conductive stopper is located on the substrate and the substrate electrode is located between the conductive stopper and the substrate contact.

24. The MEMS switch array of claim 19, further comprising the conductive trace electrically coupled to the movable actuator and located on the substrate at least partially under the movable actuator.

25. The MEMS switch array of claim 24, wherein at least one conductive stopper is integrated with at least one of the movable actuators such that when a movable actuator having a conductive stopper is actuated, the conductive stopper contacts the conductive trace.

* * * * *